US006987928B2

(12) United States Patent
Shields

(10) Patent No.: US 6,987,928 B2
(45) Date of Patent: Jan. 17, 2006

(54) RECIRCULATING AIR SNOW MELTING PAD SYSTEM

(76) Inventor: Chris Shields, 1210 Muirfield Point, Champaign, IL (US) 61822

( * ) Notice: Subject to any disclaimer, the term of this patent is extended or adjusted under 35 U.S.C. 154(b) by 11 days.

(21) Appl. No.: 10/845,613

(22) Filed: May 14, 2004

(65) Prior Publication Data

US 2005/0254802 A1 Nov. 17, 2005

(51) Int. Cl.
*E01H 5/10* (2006.01)

(52) U.S. Cl. ..... 392/379; 219/528; 219/213; 165/46; 165/45

(58) Field of Classification Search ..... 392/379, 392/432–437, 492–493; 219/213, 528, 549; 165/45–46, 53; 237/69
See application file for complete search history.

(56) References Cited

U.S. PATENT DOCUMENTS

| | | | | |
|---|---|---|---|---|
| 223,784 A | | 1/1880 | Watson | |
| 1,078,207 A | * | 11/1913 | Michael | 165/46 |
| 2,659,803 A | * | 11/1953 | Mayes | 219/213 |
| 3,818,892 A | | 6/1974 | Von Kohorn | |
| 4,059,095 A | * | 11/1977 | Grundmann et al. | 126/624 |
| 4,270,596 A | | 6/1981 | Zinn et al. | |
| 4,646,818 A | | 3/1987 | Ervin, Jr. | |
| 5,003,157 A | | 3/1991 | Hargrove | |
| 5,591,365 A | | 1/1997 | Shields | |

FOREIGN PATENT DOCUMENTS

| | | | |
|---|---|---|---|
| DE | 3126441 | * | 2/1983 |
| FR | 2470936 | * | 6/1981 |
| JP | 3-87479 | * | 4/1991 |
| JP | 6-108430 | * | 4/1994 |
| JP | 10-8773 | * | 1/1998 |
| JP | 11-81217 | * | 3/1999 |
| JP | 2002-147062 | * | 5/2002 |

* cited by examiner

*Primary Examiner*—John A. Jeffery
(74) *Attorney, Agent, or Firm*—Richard C. Litman

(57) ABSTRACT

A recirculated heated air mat system melts snow and ice from driveways or roofs, preventing its accumulation. The driveway sized, hollow mat of tough, pliable rubber, plastic is resistant to tearing and abrasion. A recirculating air electric heater provides heated air to the mat. The mat contains baffles directing heated air sinuously through the substantial portion of the mat, and an internal wall forms a cooled air return path along the upper end for recirculating the air to the heater. For a two-car garage, two pads are provided. The second pad may be identical to the first pad. Heated air is directed between the first and second mats and returned through the cooled air return path by separate removable ducts between heating air paths and cooled air return paths. The system may be modular, being assembled from identical mats and ducts. A large single mat for a roof is provided.

20 Claims, 10 Drawing Sheets

RECIRCULATING AIR SNOW MELTING PAD SYSTEM

BACKGROUND OF THE INVENTION

1. Field of the Invention

The present invention relates to snow and ice melting equipment. More particularly, the present invention relates to equipment for maintaining sidewalks, driveways, and roofs free of ice and snow.

2. Description of the Related Art

The use of heating coils or the like to maintain surfaces such as sidewalks, driveways, and roofs free from buildup of ice and snow is known. Commonly used devices include steam or hot water heated coils within or underneath the surface material such as concrete or the like. Also known is the use of electrical resistance heating systems including mats for placement over the surface to be cleared having resistance heating elements therein. In some applications resistance electrical heating mats are uneconomical. It would be desirable to provide an alternative mat type system which may use recirculated heated air and which may be placed on the surface to be kept clear of snow, such as a driveway, and is sufficiently sturdy to walk or drive a car over without damage.

U.S. Pat. No. 223,784, issued Jan. 20, 1880, to Watson, describes a sidewalk having a fluid circuit of tubes under the surface for conveying steam for heating the sidewalk to prevent snow and ice from accumulating on the surface.

U.S. Pat. No. 3,818,892, issued Jun. 25, 1974, to Von Kohorn, describes a system for removing snow and ice from an athletic playing surface where heated air is circulated beneath the surface and up through the porous playing surface.

U.S. Pat. No. 4,270,596, issued Jun. 2, 1981, to Zinn et al., describes a heat exchanger for use in embedded radiant heating systems including a plurality of webbed tube mats and associated manifolds.

U.S. Pat. No. 4,646,818, issued Mar. 3, 1987, to Ervin, Jr., describes heated mats for melting snow and ice from walkways, driveways, and sidewalks employing tubing carrying a heated mixture of water and antifreeze.

U.S. Pat. No. 5,003,157, issued Mar. 26, 1991, to Hargrove, describes a snow melting pathway mat apparatus which is electrically heated and includes hollowed channels extending longitudinally along the mat, allowing melted snow to flow off the mat.

U.S. Pat. No. 5,591,365, issued Jan. 7, 1997, to Shields, describes a lattice-like heating mat having electrical resistance heating wire extending through the lattice, the lattice configuration allowing flexibility in conforming to uneven surfaces and for rolling up for storage.

None of the above inventions and patents, taken either singly or in combination, is seen to describe the instant invention as claimed. Thus a mat system using recirculated heated air to melt snow solving the aforementioned problems is desired.

SUMMARY OF THE INVENTION

The mat system of the present invention employs recirculated heated air to melt snow and ice from walkways, driveways or roofs, preventing its accumulation on these surfaces or the like. In the driveway configuration, a mat is provided of appropriate size having upper and lower walls made of tough, pliable rubber, plastic, or the like which is sufficiently resistant to tearing and abrasion to withstand walking or driving a car over the mat. A recirculating air electric heater provides heated air to the interior of the mat. The mat contains baffles to form heated air paths to direct the heated air sinuously through the substantial portion of the mat, and an internal wall forms a cooled air return path along the upper end for recirculating the air to the heater.

For a two-car garage, two pads are provided. The second pad may be identical to the first pad. Heated air is directed between the first and second mats for sinuous flow therethrough and returned through the cooled air return path by providing separate removable ducts between heating air paths and cooled air return paths. The mat system in a preferred form is modular, being assembled from identical mats and ducts so as to provide any desired number of melting mats to cover a driveway for two or more cars or a flat roof. A large single mat for a roof is provided employing an industrial-sized electrical recirculating air heater employing commercial electrical power.

It is an aspect of the invention to provide improved elements and arrangements thereof for the purposes described which is inexpensive, dependable and fully effective in accomplishing its intended purposes.

These and other aspects of the present invention will become readily apparent upon further review of the following specification and drawings.

BRIEF DESCRIPTION OF THE DRAWINGS

Similar reference characters denote corresponding features consistently throughout the attached drawings. The features of the drawings are not necessarily drawn to scale but are for illustration only.

DETAILED DESCRIPTION OF THE PREFERRED EMBODIMENTS

The present invention is a mat system employing recirculated heated air to melt snow and ice from walkways, driveways or roofs, preventing its accumulation on these surfaces or the like. In the driveway configuration, a mat is provided of appropriate size having upper- and lower walls made of rubber, plastic, or the like which is sufficiently resistant to tearing and abrasion to withstand walking or driving a car over the mat. A recirculating air electric heater and blower provides heated air to the interior of the mat. The mat contains baffles to form heated air paths to direct the heated air sinuously through the substantial portion of the mat, and an internal wall forms a cooled air return path along the upper end for recirculating the air to the electric heater and blower. The mat system may be modular, assembled from identical mats and ducts so as to provide any desired number of melting mats to cover a driveway for two or more cars or a flat roof. Another embodiment provides a single, large heating mat for use on a roof of a commercial building or the like and employs an industrial sized heater and blower which may use commercial electrical power such as 220 or 440 volt power.

Referring to the Figures, melting pad system 10 is shown installed on a concrete or asphalt driveway D (see FIG. 1) leading from street S and garage door GD. A sidewalk SW is shown in a typical location and is cleared by the melting mat system 10. A lawn L is located on each side of the driveway D. The system 10 may be expanded to include multiple pads for melting snow from larger areas (see FIGS. 3–6) to cover multiple car driveways and flat roofs.

Figure 1:
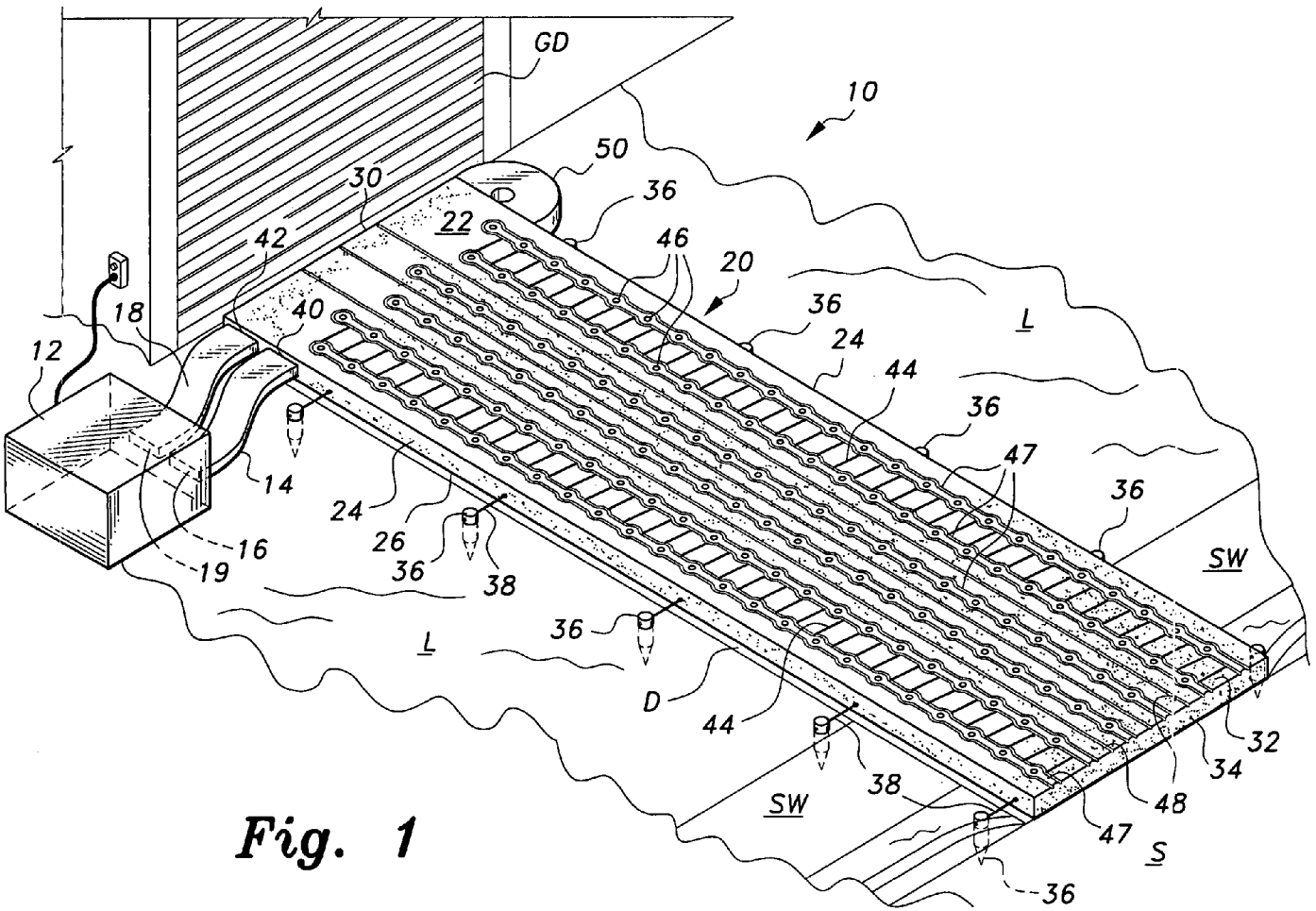
FIG. 1 is an environmental, perspective view of the heated air snow-melting mat of present invention.
Figure 2A:
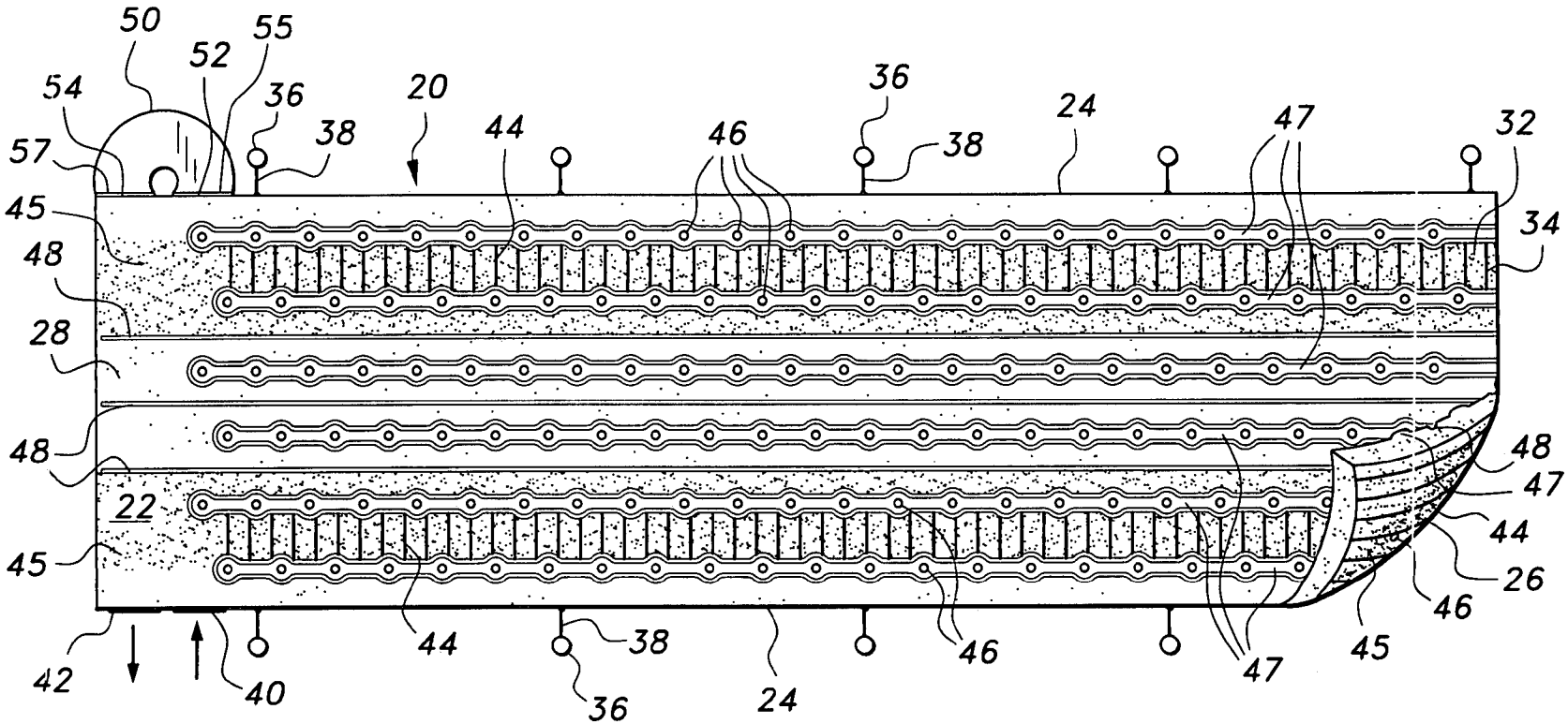
FIG. 2A is a plan view of the snow melting mat of FIG. 1.

Referring to FIGS. 1 and 2 there are shown an environmental perspective and a plan view of the preferred embodiment of the present invention showing the basic arrangement of parts of the melting pad system 10, including electrically operated recirculating air heater and blower unit 12 of conventional design having a heated air supply conduit 14 connected with an outlet 16 of unit 12 and a cool air return conduit 18 connected with an inlet 19 of unit 12. Melting mat 20 is generally rectangular in shape and has a mat upper wall 22, first and second sidewalls 24, lower wall 26, upper end wall 30 and lower end wall 34. Conduits 14 and 18 are preferably connected to the first sidewall 24. Driveways D are typically sloped upward from the level of street S to the garage door GD to keep rainwater from draining into the garage and the melting mat system 10 is defined relative to this configuration of driveway. Melting mat 20 defines an upper end portion 28 for receiving and returning air from recirculating air heater and blower 12, which is most conveniently located near the garage or house. A lower end portion 32 is located at the driveway entrance as shown, however the melting mat 20 may be of any desired length. For example, end wall 34 may be located short of the sidewalk SW.

Tie-down stakes 36 are conveniently spaced along the sides of driveway D and driven into lawn L and provide for anchoring of mat 20 by means of connecting ties 38, preferably of elastic material, to sides 22 of anchor mat 20 for securing mat 20 in position during high wind conditions.

Figure 4:
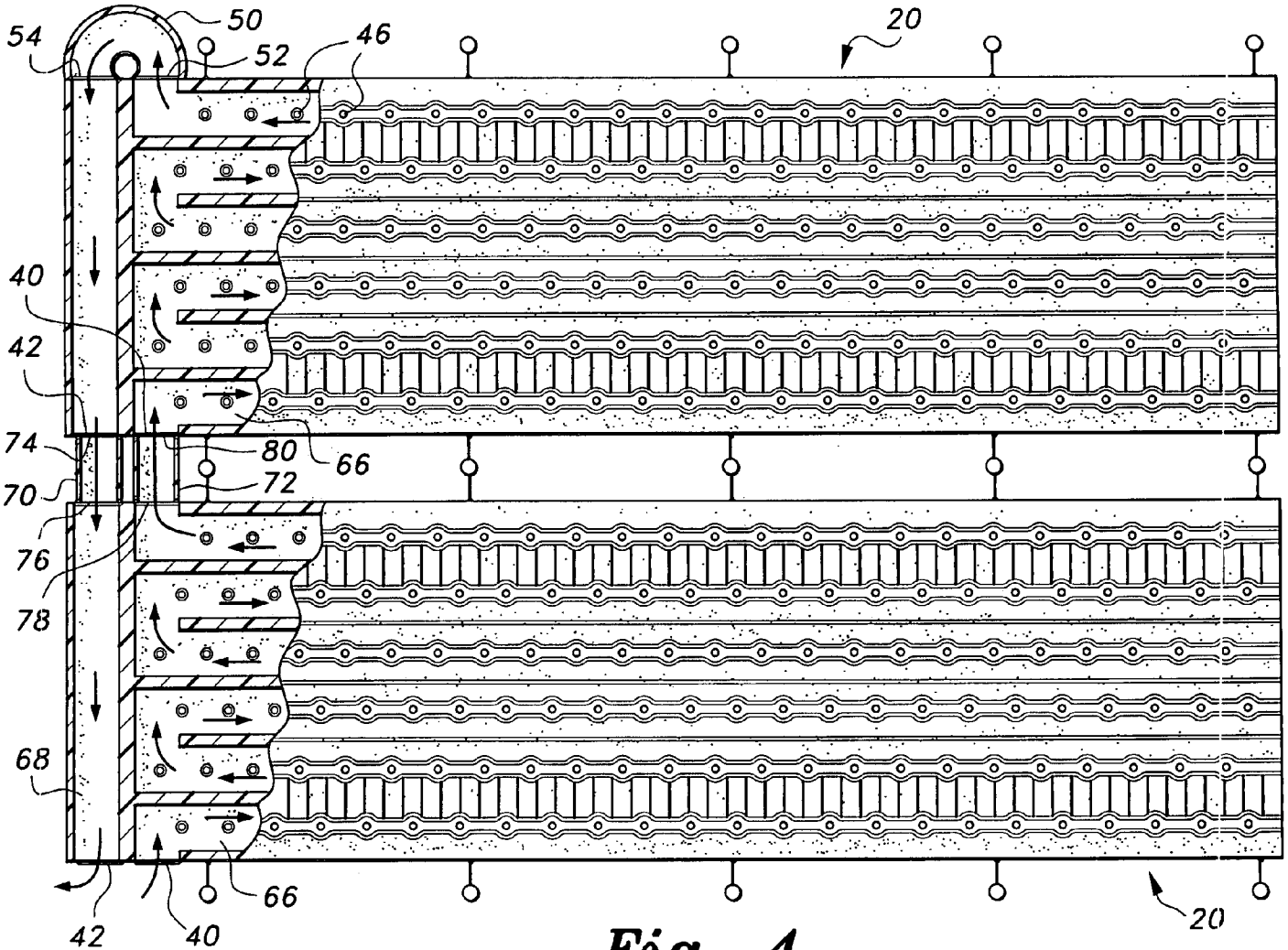
FIG. 4 is a plan view of two snow melting mats as in FIG. 1 connected in series, with the upper wall partially broken away.
Figure 5:
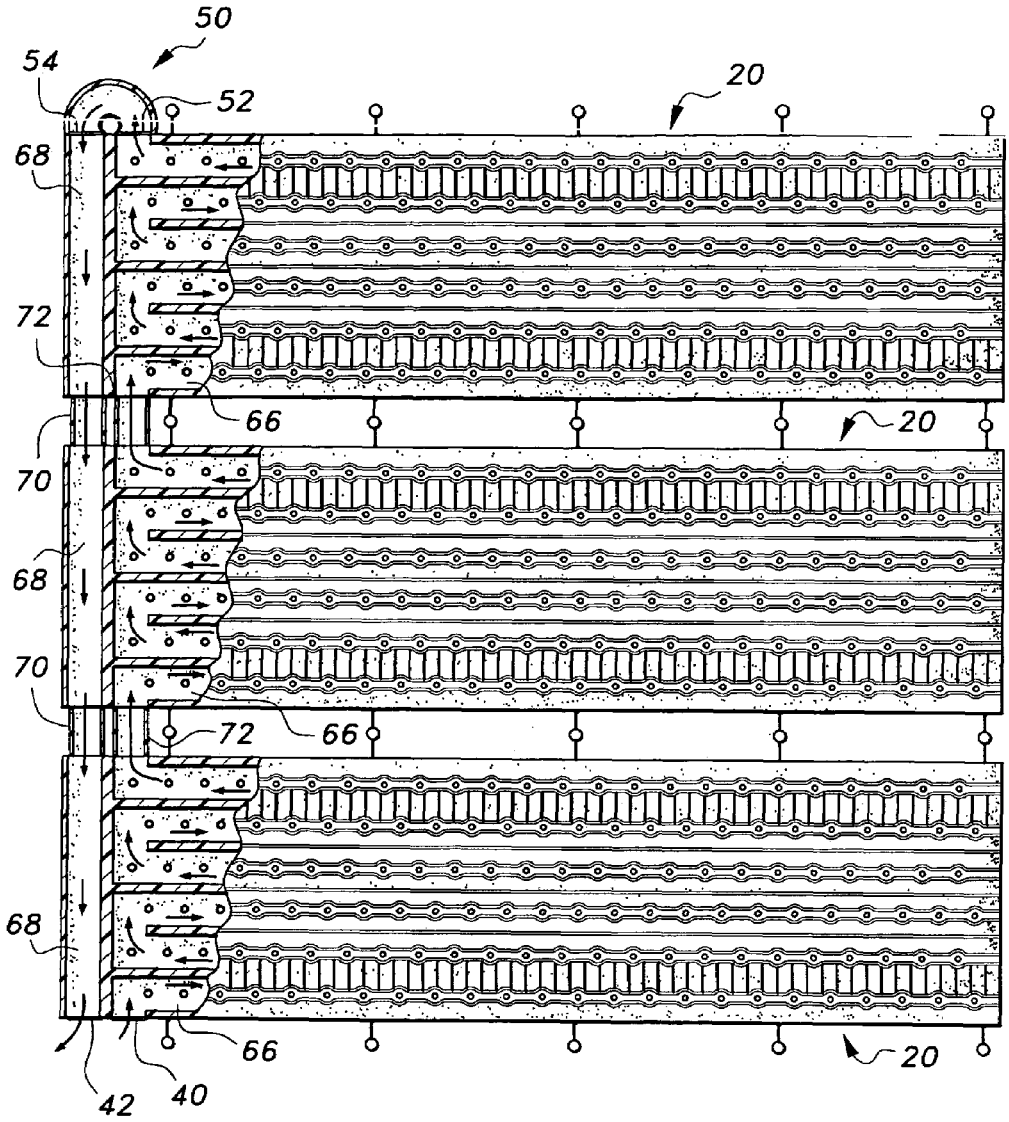
FIG. 5 is a plan view similar to that of FIG. 4 with three melting mats connected in series.

Upper end portion 28 of melting mat 20 has mat heated air inlet port 40 and mat cool air outlet port 42 along each sidewall 22 for interconnection with conduits 14 and 16, respectively, and heated air and cold air return connecting ducts 10 and 72, respectively (see FIGS. 4–6).

The melting mat 20 has parallel, spaced traction treads 44 on its upper wall 22 having a rough or ribbed surface extending the substantial length of mat 10 so as to provide traction for vehicle tires as a vehicle is driven into the garage with the garage door GD lifted. Non-skid material such as waterproof grit covered sheet material 45 (see FIGS. 2A and 2B) may be applied to the upper wall surface in tracks up to 3 feet wide or more to provide for additional vehicle tire traction or footing, the material conforming to the airflow tube and drain channel features (see discussion below). Non-skid material may also be used to cover the lower surface of the lower wall 26 of mat 20. The vehicle would not normally be parked on the mat 20 since its weight could block circulation of air through the mat system.

Mat 20 incorporates wind relief tubes 46 therethrough opening between upper and lower walls 22 and 26 in surface areas other than the traction treads 44 and which allow wind to pass through the mat 20 when lifted by a cross wind, thereby aiding in maintaining the mat in its location on the driveway D. The relief tubes 46 are preferably spaced in rows parallel with sidewalls 24, each row being surrounded by raised strips 47 extending along each row rising upward from upper wall 22 to minimize water drainage into tubes 46. Water drain channels 48 extend along the substantial length of mat 20 and allow water from melted snow to drain off the pad 20, thus avoiding refreezing of the melted snow and clogging of wind relief tubes 46. The diameter of relief tubes 46 and width and depth of water drain channels 48 may be selected depending local weather conditions, the thickness of the mat, and the thickness of the upper wall material forming the mat 20.

Figure 2B:
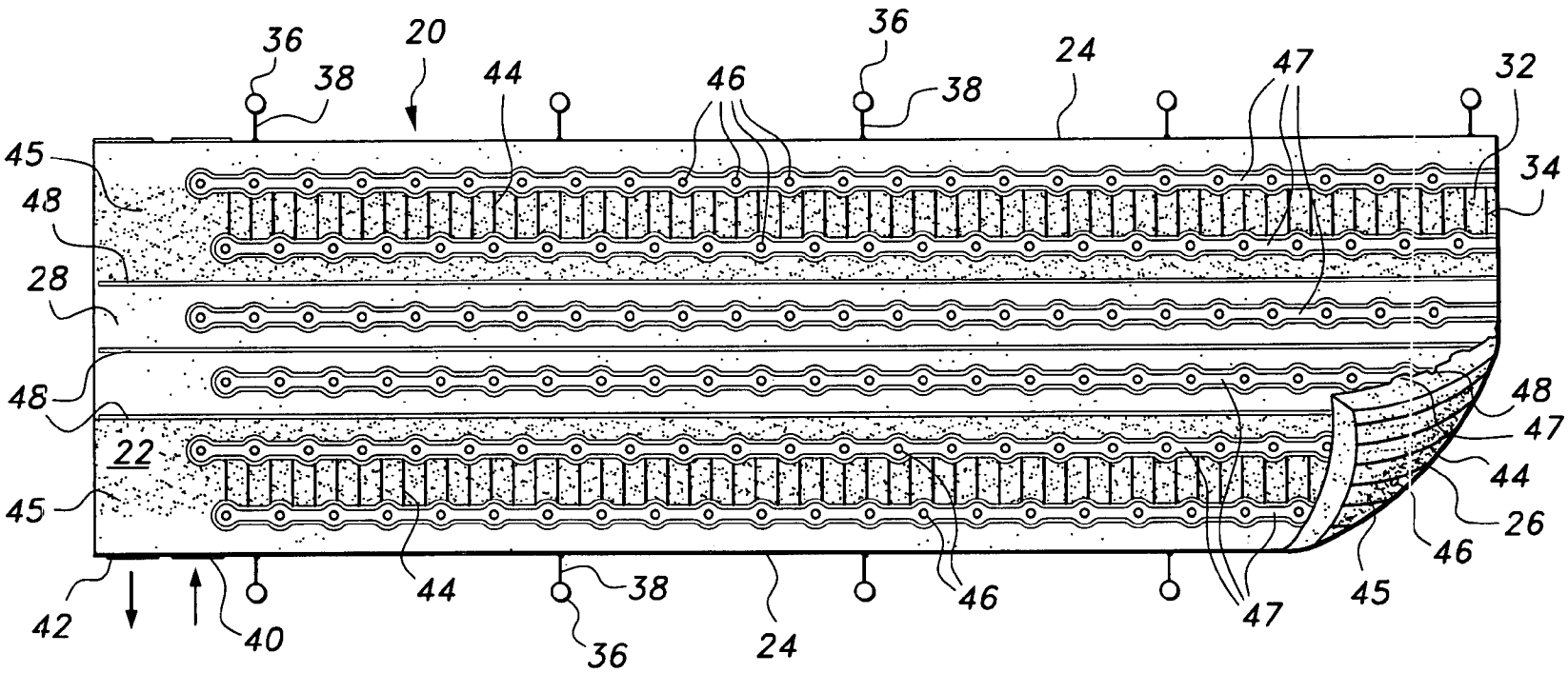
FIG. 2B is a plan view of a single mat design similar to that of FIG. 2A.

FIG. 2B shows an alternative embodiment of the invention where only a single snow melting mat 20 is contemplated. In this embodiment the second sidewall 24 opposite the first sidewall 24 having heated air inlet port 40 and cool air outlet port 42 extends upward to meet upper wall 30.

Figure 3A:
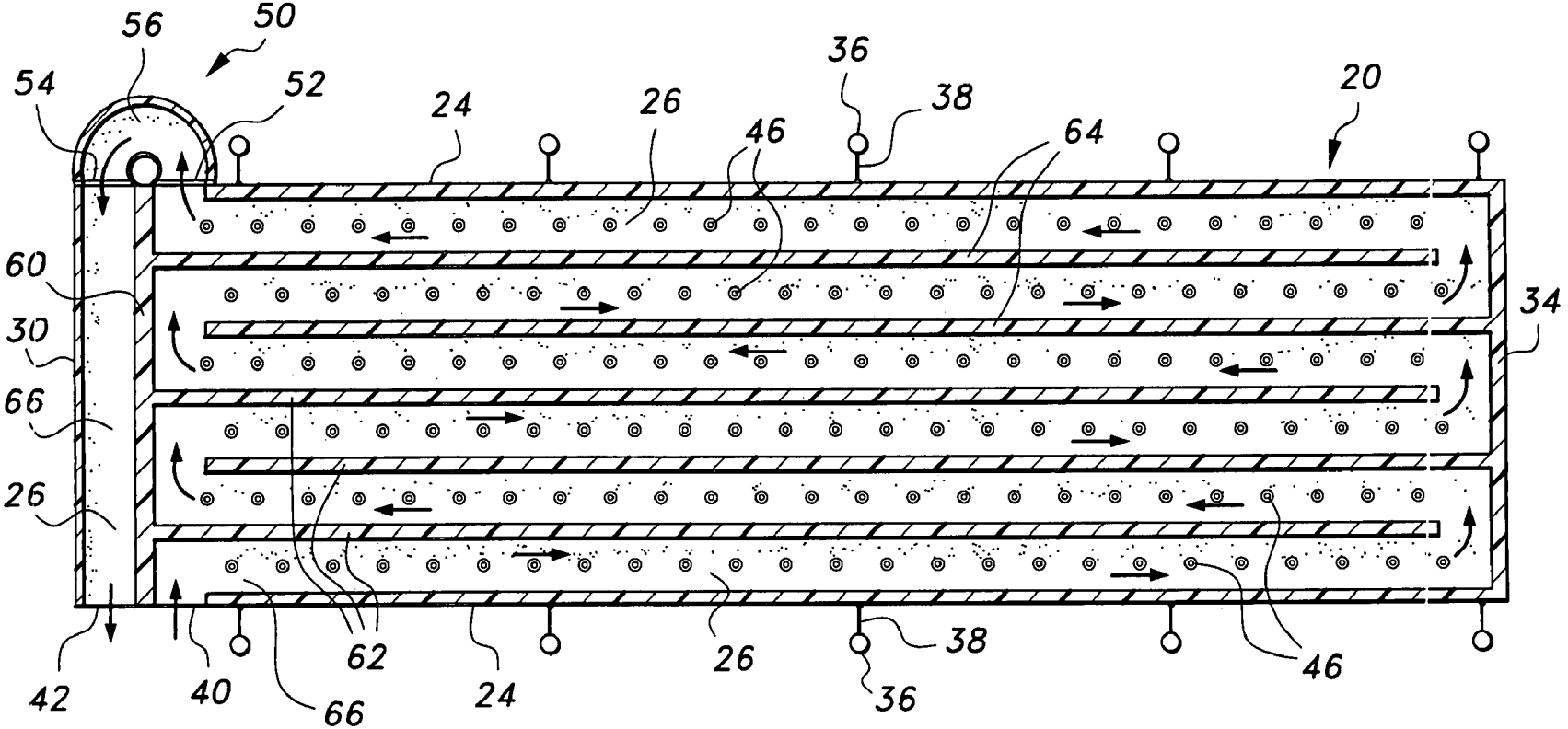
FIG. 3A is a section view of the mat of FIG. 2A with the upper wall removed.

As best seen in FIG. 3A, heated air is maintained separate from cool return air by air return wall 60. Heated air introduced through heated air inlet port 40 is directed sinuously through the substantial portion of mat 20 by alternating upper wall baffles 62 extending lengthwise from air return wall 60 and lower wall baffles 64 extending lengthwise from lower end wall 34, forming sinuous path 66. Cooled air is returned for heating and recycling in unit 12 by along cool air return path 68 formed by cool air return wall 60 and upper end wall 30 and the upper and lower walls of mat 20. Elbow duct 50 connects heated air exit port 52 to cooled air return port 54 for return of the circulating air along cool air return path 68. Wind relief tubes 46 are preferably located in rows within sinuous path 66, centered between baffles 62 and 64, respectively.

Figure 3B:
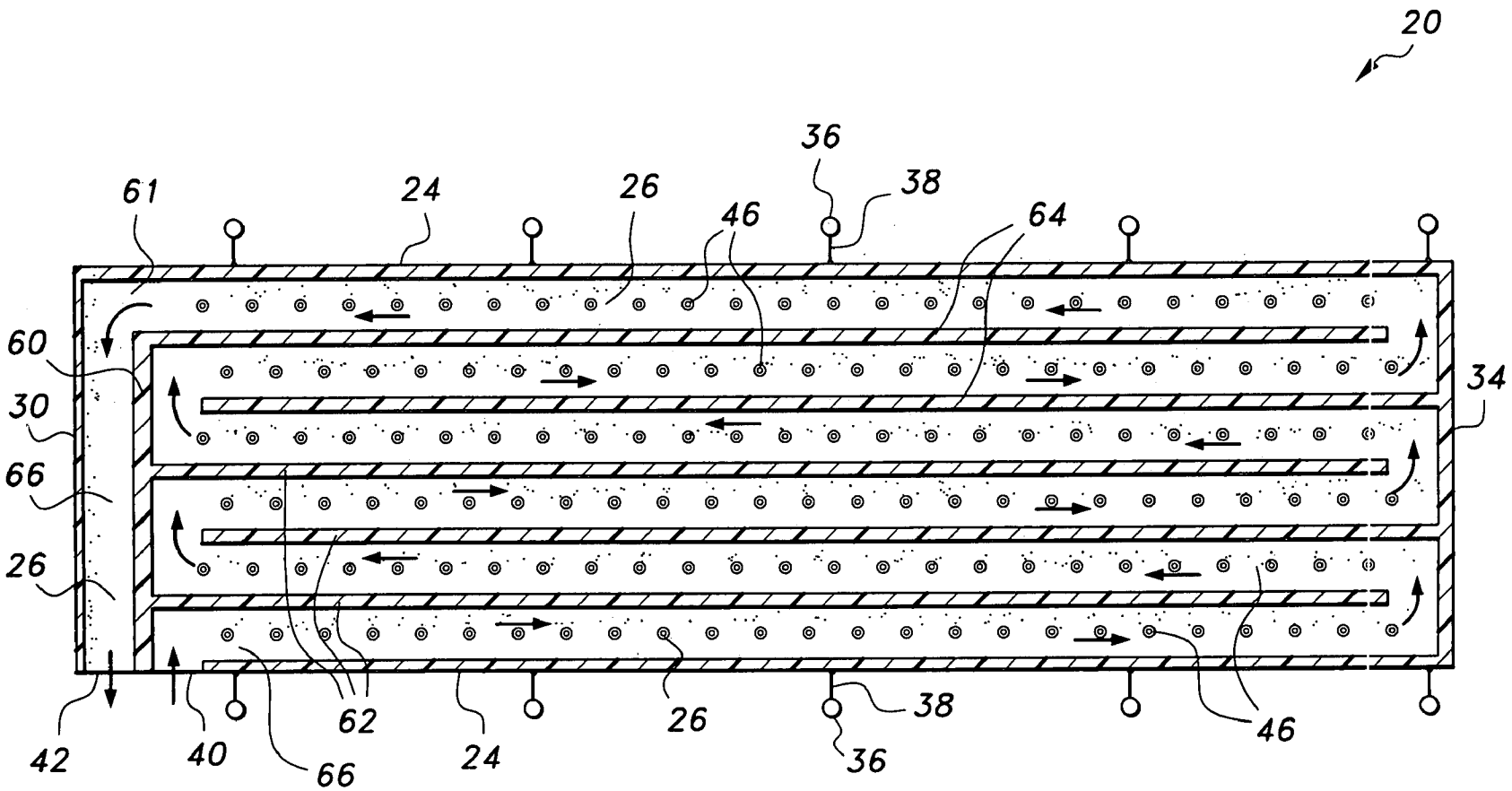
FIG. 3B is a section view of the mat of FIG. 2B with the upper wall removed.

Referring to FIG. 3B, there is shown a section view of the embodiment of FIG. 2B, wherein inner cold air return wall 60 ends at upper wall baffle 62 providing an internal return port 61 for directing cooled air for return to mat cool air outlet port 42 from the opposite mat side wall 24.

As best seen in FIGS. 3–5, multiple snow melting mats 20 may be interconnected by cool air return connecting ducts 70 and heated air connecting ducts 72. Cool air return connecting ducts 70 connect cool air outlet port 42 to cooled air return ports 54. Heated air connecting ducts 70 connect heated air exit ports 52 with mat heated air inlet ports 0.40. Connecting ducts 70 and 72 may be identical in configuration. The last of the series of mats 20 may be identical to that of the first mat 20, employing elbow duct 50 for recirculating air through the mat system. Alternatively, the last of the series of mats 20 may be configured as shown in FIGS. 2B and 3B and elbow duct 50 is not required for operation of the mat system.

Figure 6A:
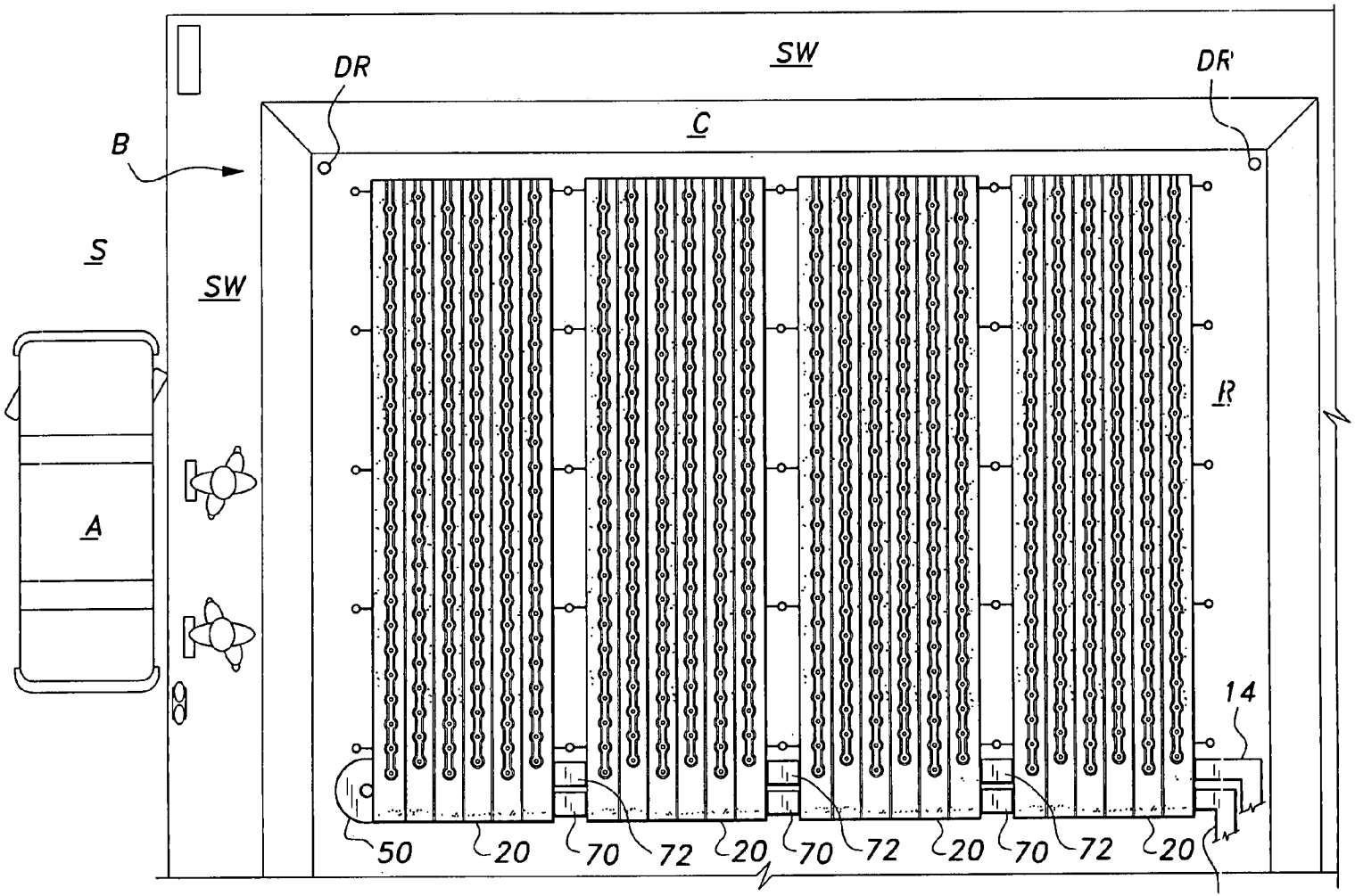
FIG. 6A is an environmental plan view of a series of mats similar to that of FIG. 1 located for melting snow from a flat roof.

Referring to FIG. 6A, there is shown another application of the recirculating heated air snow melting mat system 10 of the present invention where melting mats 20 are installed on the flat roof R (slightly sloping for drainage) of a commercial building. The building has a cornice C and overlooks a sidewalk SW and a street S for travel of automobile A. The mat system 10 is installed such that water drains from cavities 48 along the slope of the roof R to drains DR in roof R. The ties 38 may be tied to stakes 36 installed in receiving tubes (not shown) or tied to eyelets or other connecting support structures of known type and design.

Figure 6B:
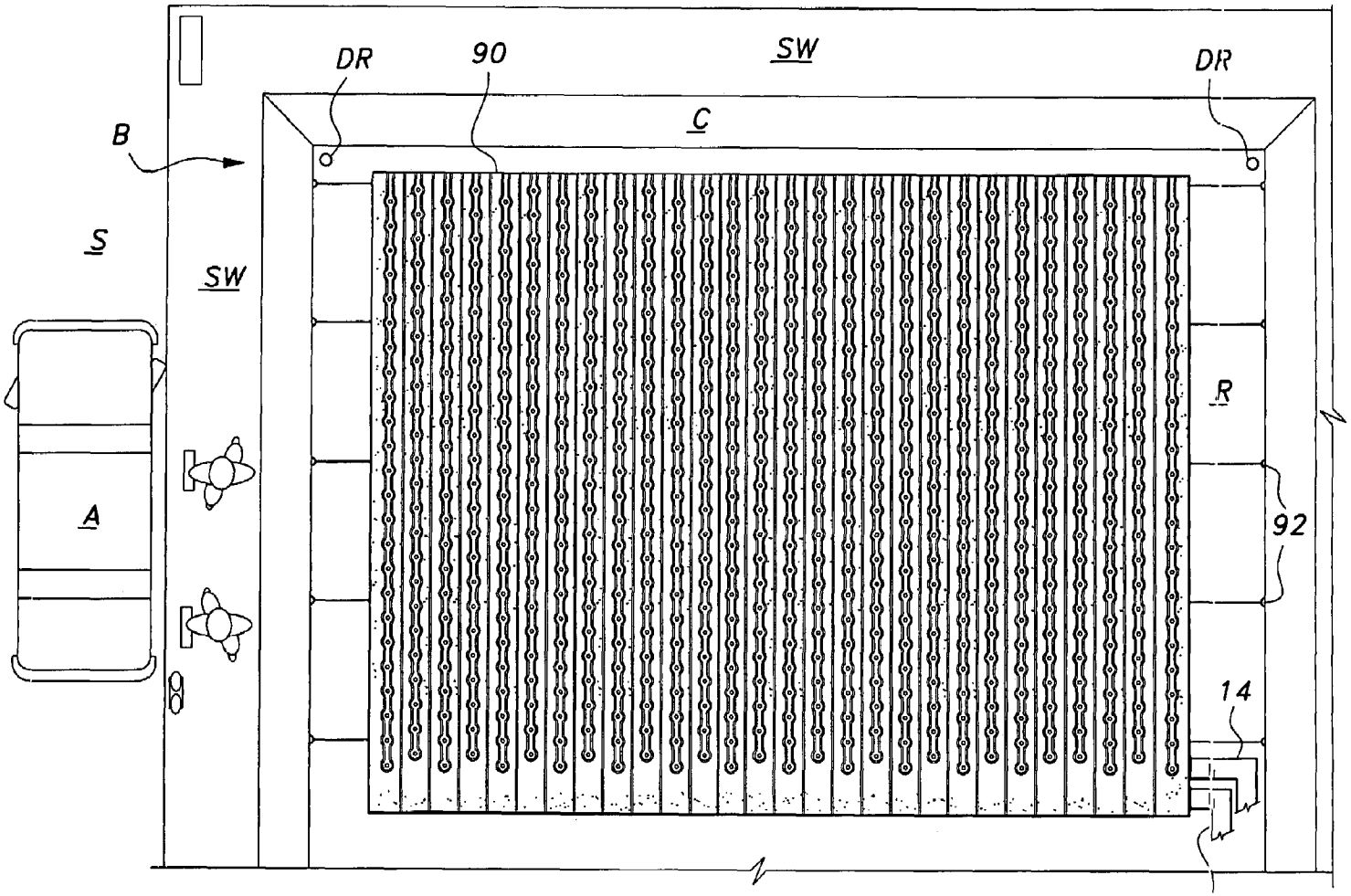
FIG. 6B is an environmental plan view similar to that of FIG. 6A of a single large mat useful for melting snow from a flat roof.

As shown in FIG. 6B, the mat system 10 may employ a single large mat 90 of greater width relative to length, as desired, the number of heated air baffles being increased (not shown) for distribution of heat over the wide mat. The roof R is shown as that of a commercial building B, the roof being substantially flat or slightly sloped and having drain holes DR. A sidewalk SW surrounds the building B next to which an automobile A is parked on street S. A single large mat substantially covering roof R may be tied securely to two or more walls of cornices C by ties to anchor bolts 92. Recirculated heated air is provided by an industrial sized electrical unit through heated air supply conduit 14 from cool air return conduit 18 in a manner similar to that of the driveway mat 20. The mat is oriented such that it drains toward drainpipes DR.

The mat 90 may also be installed on a sloping roof (not shown) if properly sized and tied down. A 220-volt AC heater and blower may be useful in this application. In a similar manner, a single mat 90 of having a double or triple width (not shown) may be used for a double or triple car driveway as desired and may include corresponding pairs of traction treads 44 thereon.

Figure 7A:
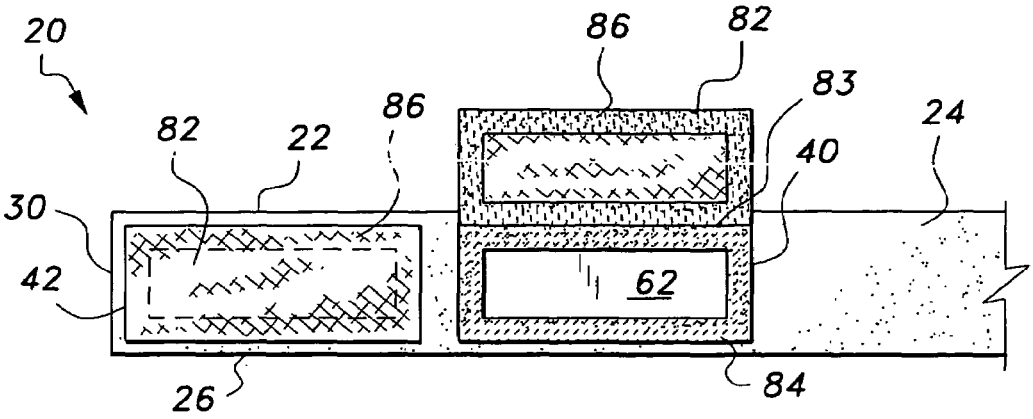
FIG. 7A is a side view of the upper end portion of the snow clearing mat showing air flow covers in closed and open position.

Referring to FIG. 7A, there is shown a side view of the upper end portion 28 of the snow clearing mat 20 showing heated air inlet port 40 and cool air outlet port 42 having covers 82 in the uncovered and covered positions, respectively. The covers are useful for storage purposes to prevent the entry of pests, dirt and debris into disassembled and stored system. The covers 82 may be hinged to the sidewall 24 by integral hinge 83 as shown for port 40 or be provided as a separate component of the system 10. The covers 82 are preferably removably connected to the sidewall 24 by hook and loop material (Velcro). As shown, port 40 is surrounded by hook material 84 and the border of cover 82 covered with loop material 86. For port 42 the engaged hook material is covered with loop material 86 (hidden lines) of a cover 82.

Figure 7B:
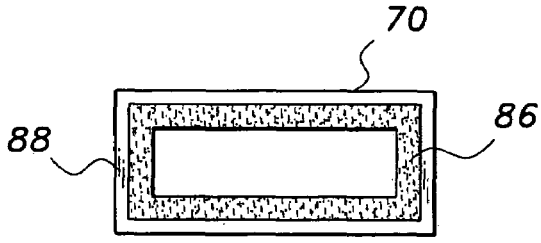
FIG. 7B is an end view of a duct of FIG. 2.

Referring to FIG. 7B there is shown an end view of a connecting duct 70 having ends 88 surrounded by loop material 86 for connection with hook material 84 of heated air inlet port 40 and cool air outlet port 42. Ducts 70 and 72 have identical ends 88 having loop material 86 for connection with heated air exit port 52 and cooled air return port 54.

Figure 7C:
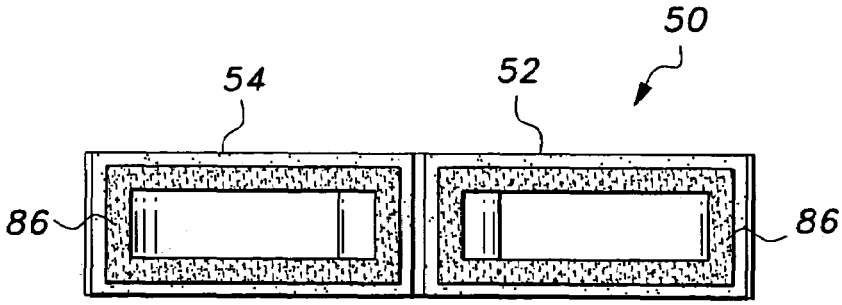
FIG. 7C is an end view of the elbow duct of FIG. 2.

Referring to FIG. 7C there is shown an end view of elbow duct 50 having elbow air inlet 55 for mating with mat heated air exit port 52 and elbow circulating air outlet 57 for mating with mat cooled air return port 54, respectively. Elbow air inlet 55 and elbow circulating air outlet 57 each have loop material 86 for connection with corresponding hook material 84 of heated air exit port 52 and cooled air return port 54, respectively.

The hook material 84 and loop material 86 (Velcro) may be interchanged between ducts the 50, 70, and 72 and the heated air inlet and exit ports and the cooled air inlet and exit ports of mat 20 as desired. The configuration of the mat connecting ends of heated air supply conduit 14 (see FIGS. 1 and 2) and cool air return conduit 18 may be identical to that of ducts 70 and 72 employing hook material and mating loop material (not shown) for removable connection therewith in the same manner.

The material of the inventive snow-melting mat is preferably a lightweight, tough, pliable plastic or rubber material. The mat is preferably from about 1" to about 2" in overall thickness. Each driveway mat 20 is preferably about 10 feet in width and of a length of from about 20 to about 30 feet in length. The single roof type mat may be from about 50 to 100 feet in width and from about 50 to 150 fee in length. The electrically powered heater and blower for the single roof type mat may be powered by 110, 220, or 480 volt electrical current.

It is to be understood that the present invention is not limited to the embodiments described above, but encompasses any and all embodiments within the scope of the following claims.

I claim:

1. A snow melting mat system for clearing driveways, sidewalks, and roofs from snow and ice comprising:

a heated air source;

a first generally rectangular snow melting mat of flexible material having an upper wall, a lower wall, an upper end wall, a lower end wall, and spaced first and second sidewalls defining an interior space, said mat being positioned lengthwise from said upper wall to said lower wall during use, substantially covering the driveway;

said mat defining a heated air inlet port communicating with said interior space;

a heated air conduit extending between said heated air source and said heated air inlet port;

a plurality of spaced baffles located within said interior space of said mat extending between said upper wall and said lower wall and forming a sinuous path directing heated air received through said heated air inlet port from said heated air source through the substantial portion of said interior space as heat is conducted through said upper wall for melting snow thereon;

a cool air outlet port in said mat for exhaust of air from said interior space of said mat, said cool air exit being so located as to exhaust said air at a point past said sinuous path;

a cool air return conduit extending between said cool air outlet port and said heated air source;

said mat having an upper end portion defined by said upper end wall and the upper portions of said first and second sidewalls, said mat further comprising a cool air return wall within said mat upper end portion extending between said upper and lower walls, said cool air return wall extending between said mat sidewalls and parallel with and spaced from said upper end wall and forming a cool air return path, said cool air return wall separating said heated air inlet port from said cool air outlet port, said heated air inlet port and said cool air outlet port being located in said first sidewall in said upper end portion of said mat proximate said heated air source;

whereby heated air is introduced from said source through said conduit and into said mat, gives up heat through said upper wall as it travels said sinuous path, thereby melting snow and ice on said mat, and is exhausted from said mat.

2. The system of claim 1, further comprising a cool air return conduit extending between said cool air outlet port and said heated air source for recirculating cooled air from said mat to said heated air source for reheating, forming a closed circulating system.

3. The system of claim 2, said mat having an upper end portion defined by said upper end wall and the upper portions of said first and second sidewalls, said mat further comprising a cool air return wall within said mat upper end portion extending between said upper and lower walls, said cool air return wall extending between said mat sidewalls and parallel with and spaced from said upper end wall and forming a cool air return path, said cool air return wall separating said heated air inlet port from said cool air outlet port, said heated air inlet port and said cool air outlet port being located in said first sidewall in said upper end portion of said mat proximate said heated air source.

4. The system of claim 3, wherein said baffles extend parallel with said sidewalls and alternately extend downward from said cool air return wall and upward from said lower end wall, forming said sinuous path so as to extend alternately downward and upward through said substantial portion of said mat, whereby heated air enters through said heated air inlet port, gives up heat within said sinuous path, enters said cool air return path and exits said mat through said cool air outlet port.

5. The system of claim 4, said cool air return wall defining an inner cool air return port proximate said second sidewall for passing air from said sinuous path formed by said baffles to said cool air path formed between said cool air return wall and said upper end wall.

6. The system of claim 4, said second sidewall defining a heated air exit port and a cooled air return port in said upper end portion of said mat, said cool air return wall separating said heated air exit port and said cooled air return port, said system further comprising an elbow duct connecting said heated air exit port and said cool air return port for directing circulating air from said sinuous path to said cool air return path.

7. The system of claim 6, further comprising a heated air connecting duct, a cool air return connecting duct and a second mat identical to said first mat, said second mat being fluidly connected with said first mat by said heated air connecting duct fastened between said heated air exit port of said first mat and said heated air inlet port of said second pad, and by said cool air return connecting duct fastened between said cooled air return port of said first pad and said cool air outlet port of said second pad, said elbow duct connecting said heated air exit port and said cooled air return port of said second mat for directing circulating air from said sinuous path of said second mat to said cool air return path of said second mat.

8. The system of claim 7, wherein said system is modular, having a plurality of identical said mats in series and an equal plurality of heated air connecting ducts and cool air return connecting ducts connected in like manner as said first and said second mats, whereby recirculated heated air enters said first mat through said heated air conduit, gives up heat while flowing through said sinuous paths of said plurality of identical mats in succession, the cooled air being directed from said sinuous path of the last of said identical mats by said elbow duct to flow through a cool air return path form by said plurality of identical mats to said cool air return duct for recirculating and heating said air by said heated air source.

9. The system of claim 8, said heated air connecting ducts being removably connected with said respective heated air exit ports and heated air inlet ports by mating hook and loop material, said cool air return connecting ducts being removably connected with said respective cooled air return ports and said cool air outlet ports by mating hook and loop material, said elbow duct being removably connected with said last of said plurality of mats for airflow between said heated air exit port and said cooled air return port by mating hook and loop material, said heated air conduit from said heated air source being removably connected with said heated air inlet port of said first mat by mating hook and loop material, said cool air conduit to said heated air source being removably connected with said cool air outlet port of said first mat by mating hook and loop material.

10. The system of claim 9, further comprising a plurality of covers for removably closing said heated air exit ports, said heated air inlet ports, said cooled air return ports and said cool air outlet ports, said covers bearing hook or loop material respectively mating therewith.

11. The system of claim 10, said covers being connected with said respective sidewalls of said plurality of mats by integral hinges proximate said ports for selective opening and closing and closing of said ports.

12. The system of claim 6, said mat having a plurality of wind conducting tubes extending between said upper wall and said lower wall forming corresponding ports in said upper wall and said lower wall for conducting wind therethrough when said mat is lifted from the driveway or other surface due to high wind conditions, thus reducing the force of the wind against the underside of said mat.

13. The system of claim 12, said plurality of wind conducting tubes being mutually spaced and forming a plurality of rows parallel with said mat sidewalls, said upper wall forming raised strips connecting and surrounding corresponding said rows of said wind conducting tube ports.

14. The system of claim 13, said upper wall forming a plurality of water drain channels in its upper surface extending parallel with said mat sidewalls, and spaced between said rows of wind conducting tube ports, said drain channels opening at said lower end wall of said mat for receiving and draining water from melted snow from said mat upper wall.

15. The system of claim 6, said mat upper wall having a pair of traction treads of a surface selected from at least one of the group comprising a rough or ribbed surface formed thereon and a non-skid grit surface and extending the substantial length of said mat and spaced to conform with the tires of a vehicle.

16. The system of claim 6, said mat having a plurality of spaced ties fastened to said sidewalls and a corresponding number of stakes for driving into a lawn, said ties being attached to said stakes for anchoring said mat during high wind conditions.

17. The system of claim 3, wherein said mat is of such size and dimensions as to substantially cover the roof of a building such as a flat roof of a commercial building, said mat being oriented such that said lower end of said mat drains water from melted snow near drain pipes or the lower edge of the roof.

18. A snow melting mat system for clearing driveways from snow and ice comprising:

a heated air source;

a first generally rectangular snow melting mat of flexible material having an upper wall, a lower wall, an upper end wall, a lower end wall, and spaced first and second sidewalls defining an interior space, said mat being positioned lengthwise from said upper wall to said lower wall during use, substantially covering the driveway;

said mat defining a heated air inlet port communicating with said interior space;

a heated air conduit extending between said heated air source and said heated air inlet port;

a plurality of spaced baffles located within said interior space of said mat extending between said upper wall and said lower wall and forming a sinuous path directing heated air received through said heated air inlet port from said heated air source through the substantial portion of said interior space as heat is conducted through said upper wall for melting snow thereon;

a cool air outlet port in said mat for exhaust of air from said interior space of said mat, said cool air outlet port being so located as to exhaust said air at a point past said sinuous path; and a cool air return conduit connected with said cool air outlet port and extending to said heat source, said heat source, said heated air supply conduit, said pad and said cool air return conduit forming a closed, recirculating system;

said mat having an upper end portion defined by said upper end wall and the upper portions of said first and second sidewalls, said mat further comprising a cool air return wall within said mat upper end portion extending between said upper and lower walls, said cool air return wall extending between said mat sidewalls and parallel with and spaced from said upper end wall and forming a cool air return path, said cool air return wall separating said heated air inlet port from said cool air outlet port, said heated air inlet port and said cool air outlet port being located in said first sidewall in said upper end portion of said mat proximate said heated air source;

said baffles extending parallel with said sidewalls and alternately extending downward from said cool air return wall and upward from said lower end wall, forming said sinuous path so as to extend alternately downward and upward through said substantial portion of said mat; and said second sidewall defining a heated air exit port and a cooled air return port in said upper end portion of said mat, said cool air return wall separating said heated air exit port and said cooled air return port, said system further comprising an elbow duct connecting said heated air exit port and said cool air return port for directing circulating air from said sinuous path to said cool air return path.

19. The system of claim 18, further comprising a heated air connecting duct, a cool air return connecting duct and a second mat identical to said first mat, said second mat being fluidly connected with said first mat by said heated air connecting duct fastened between said heated air exit port of said first mat and said heated air inlet port of said second pad, and by said cool air return connecting duct fastened between said cooled air return port of said first pad and said cool air outlet port of said second pad, said elbow duct connecting said heated air exit port and said cooled air return port of said second mat for directing circulating air from said sinuous path of said second mat to said cool air return path of said second mat.

20. The system of claim 19, wherein said mat has a plurality of wind conducting tubes extending between said upper wall and said lower wall forming corresponding ports in said upper wall and said lower wall for conducting wind therethrough when said mat is lifted from the driveway or other surface due to high wind conditions, thus reducing the force of the wind against the underside of said mat;

said plurality of wind conducting tubes being mutually spaced and forming a plurality of rows parallel with said mat sidewalls, said upper wall forming raised strips connecting and surrounding corresponding said rows of said wind conducting tube ports;

said upper wall forming a plurality of water drain channels in its upper surface extending parallel with said mat sidewalls, and spaced between said rows of wind conducting tube ports said drain channels opening at said lower end wall of said mat for receiving and draining water from melted snow from said mat upper wall; and said mat upper wall having a pair of traction treads of a rough or ribbed surface formed thereon and extending the substantial length of said mat and spaced so as to conform with the tires of a vehicle.

* * * * *